US006832918B2

(12) United States Patent
Hou

(10) Patent No.: US 6,832,918 B2
(45) Date of Patent: Dec. 21, 2004

(54) IC SOCKET ASSEMBLY

(75) Inventor: Sung-Pei Hou, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/837,385

(22) Filed: Apr. 30, 2004

(65) Prior Publication Data

US 2004/0219816 A1 Nov. 4, 2004

(30) Foreign Application Priority Data

Apr. 30, 2003 (TW) ..... 92206969 U

(51) Int. Cl.[7] ..... H01R 9/09
(52) U.S. Cl. ..... 439/70; 439/330
(58) Field of Search ..... 439/70, 71, 73, 439/330, 637, 701, 733.1

(56) References Cited

U.S. PATENT DOCUMENTS 5,273,441 A * 12/1993 Volz et al. ..... 439/72
5,531,608 A * 7/1996 Abe ..... 439/330
5,865,639 A 2/1999 Fuchigami et al.
6,162,066 A * 12/2000 Glick et al. ..... 439/73
6,193,525 B1 2/2001 Takayama
6,213,806 B1 4/2001 Choy
6,350,138 B1 2/2002 Atobe et al.
6,371,783 B1 4/2002 Ohashi et al.
6,626,682 B2 * 9/2003 Sausen ..... 439/70
6,676,418 B2 * 1/2004 Watanabe ..... 439/71

* cited by examiner

*Primary Examiner*—Thanh-Tam Le
(74) *Attorney, Agent, or Firm*—Wei Te Chung

(57) ABSTRACT

An integrated circuit (IC) socket assembly (1) includes an insulative housing (11), a holding component (12) and a multiplicity of electrical terminals (13). Each of the terminals includes a head portion (135) forming a first contact portion (131) at a free end thereof for electrically contacting an IC (2), a holding portion (133) engaging the terminal in the holding component, and a second contact portion (132) for electrically contacting a burn-in board (3) by Through Hole technology. Some of the terminals further include connecting portions (134) each bending from ends of the holding portions to ends of the second contact portions. Each of the connecting portions has a desired length in a horizontal direction, to decreases the difficulty of making the holes in the burn-in board and assembling the second contact portions into the burn-in board by Through Hole technology.

9 Claims, 18 Drawing Sheets

IC SOCKET ASSEMBLY

BACKGROUND OF THE INVENTION

1. Field of the Invention

The present invention relates to an integrated circuit (IC) socket assembly for electrically connecting an electronic package such as an IC with a substrate circuit such as a burn-in board.

2. Description of the Prior Art

Electronic packages, such as integrated circuits (ICs), are miniaturized electronic devices in which a number of active and passive circuit elements are located on or within a continuous body of material to perform the function of a complete circuit. To ensure reliability in use, the ICs require prior burning in to test their durability. The ICs are operated at high temperature for an extended period of time to accelerate potential failure points. This helps eliminate early product failures once the ICs are sold and/or assembled onto electronic end products. Consequently, an IC socket assembly is used to receive an IC therein, and to electrically connect the IC with a burn-in board for operation of the IC at high temperature. Pertinent examples of such IC socket assemblies are disclosed in U.S. Pat. Nos. 6,371,783, 6,350, 138, 6,213,806, 6,193,525 and 5,865,639.

An IC socket assembly generally comprises an insulative housing mounted on and electrically connected on a burn-in board, a multiplicity of electrical contacts accommodated in the houisng, and latch means for securely attached the IC in the IC socket assembly. Each contact includes a contact portion extending out of a top of the housing for electrically connected with leaders of the IC, and a pin extending out of a bottom of the housing. A distance of the contact portions of two adjacent contacts is identical with a distance of the pins of the two adjacent contacts. The pins of the contacts are electrically connected with the burn-in board by Through Hole technology.

At present, with the prevailing trend toward miniaturization of computers, the sizes of the ICs used in the computers are steadily becoming smaller. In contrast, the number of leads of the IC is increasing to meet the need for more signal transmission. A distance of two adjacent leads of the IC is decreasing, and a distance of the contact portions of two adjacent contacts is decreasing. Accordingly, a distance of the pins of the two adjacent contacts is decreasing, which increases the difficulty of making holes in the burn-in board and assembling the contacts onto the burn-in board by Through Hole technology.

In view of the above, a new IC socket assembly that overcomes the above-mentioned disadvantages is desired.

SUMMARY OF THE INVENTION

An object of the present invention is to provide a integrated circuit (IC) socket assembly for electrically connecting an electronic package such as an IC with a circuit substrate such as a burn-in board, and more particularly to provide an IC socket assembly configured to facilitate being assembled onto a burn-in board by Through Hole technology.

To fulfill the object of the present invention, an IC socket assembly in accordance with a preferred embodiment of the present invention is used for electrically connecting an IC with a burn-in board having a multiplicity of holes extending therethrough in a vertical direction. The IC socket assembly comprises an insulative housing, a holding component assembled in the housing and a multiplicity of electrical terminals received in the holding component. Each of the terminals comprises a head portion forming a first contact portion at a free end thereof for electrically contacting the IC, a holding portion engaging the terminal in the holding component, and a second contact portion for electrically contacting the burn-in board by Through Hole technology. Some of the terminals further comprise connecting portions each bending from ends of the holding portions to ends of the second contact portions. Each of the connecting portions extends a desired distance in a horizontal direction, such that a distance between two adjacent second contact portions in one row is larger than a distance between two adjacent first contact portions in one row. Therefore, it is likely to decreases the difficulty of making the holes in the burn-in board and assembling the second contact portions into the burn-in board by Through Hole technology.

Other objects, advantages and novel features of the invention will become more apparent from the following detailed description when taken in the conjunction with the accompanying drawings.

DETAILED DESCRIPTION OF THE PREFERRED EMBODIMENT OF THE INVNETION

Reference will now be made to the drawings to describe the present invention in detail.

Figure 9:
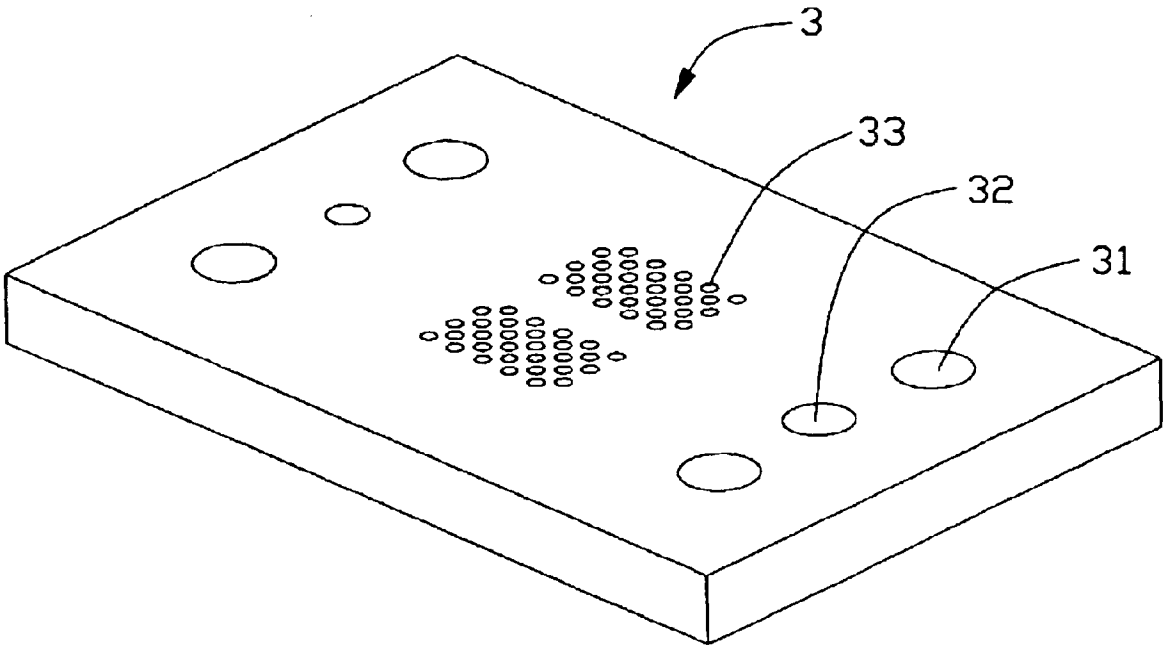
FIG. 9 is an isometric view of the burn-in board of FIG. 8.

Referring to FIGS. 1 through 5 and 10 through 12, An integrated circuit (IC) socket assembly 1 in accordance with the preferred embodiment of the present invention is used for electrically connecting an electronic package such as an IC 2 with a circuit substrate such as a burn-in board 3. The IC socket assembly 1 comprises an insulative housing 11, a holding component 12, a plurality of electrical terminals, and a pair of pushing members 1117. Referring to FIG. 9, the burn-in board 3 defines four first holes 31 in four corners of a rectangle respectively, a pair of second holes 32 defined in a portion between two first holes 31 in a width of the rectangle, and a plurality of third holes 33 defined in a middle of a portion surrounded by the rectangle and arranged in six rows rectangular. Each of the first, second and third holes 31, 32, 33 extends through the burn-in board 3 in a vertical direction. A diameter of each first hole 31 is larger than a diameter of one of the second holes 32. A diameter of one second hole 32 is larger than a diameter of the other second hole 32.

Figure 2:
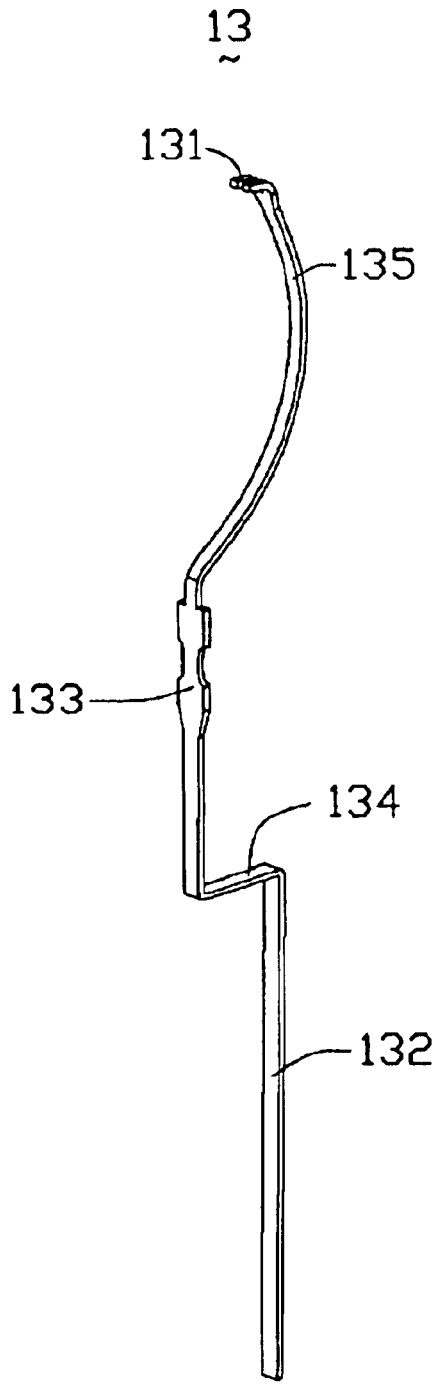
FIG. 2 is an enlarged, isometric view of one of the first terminals of the IC socket assembly of FIG. 1.
Figure 3:
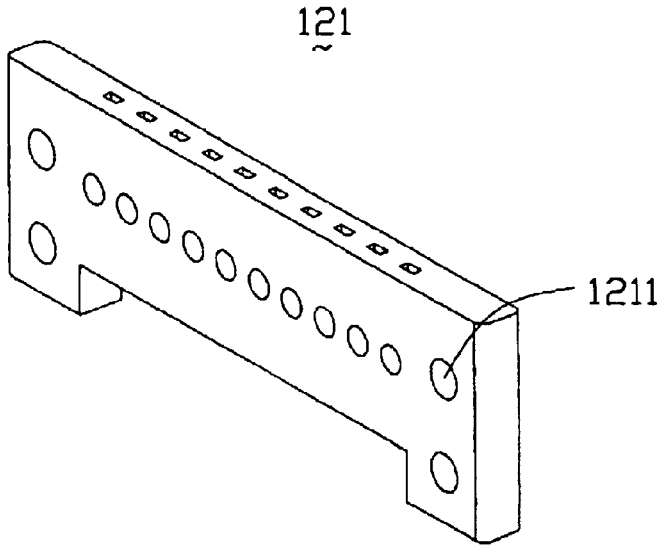
FIG. 3 is an enlarged, isometric view of one of the first holding elements of the IC socket assembly of FIG. 1.

Referring to FIG. 2, each of the terminals 13 comprises an arc-shaped head portion 135, a first contact portion 131 formed at an end of the head portion 135, a holding portion 133 extending downwardly from an opposite end of the head portion 135, and a second contact portion 132 capable of inserting into a third hole 33 of the burn-in board 3 to connecting with the burn-in board 3 electrically. Each of the terminals 13 have connecting portions 134 bending from a lower end of the holding portion 133 to an end of the second contact portion 132.

Figure 5:
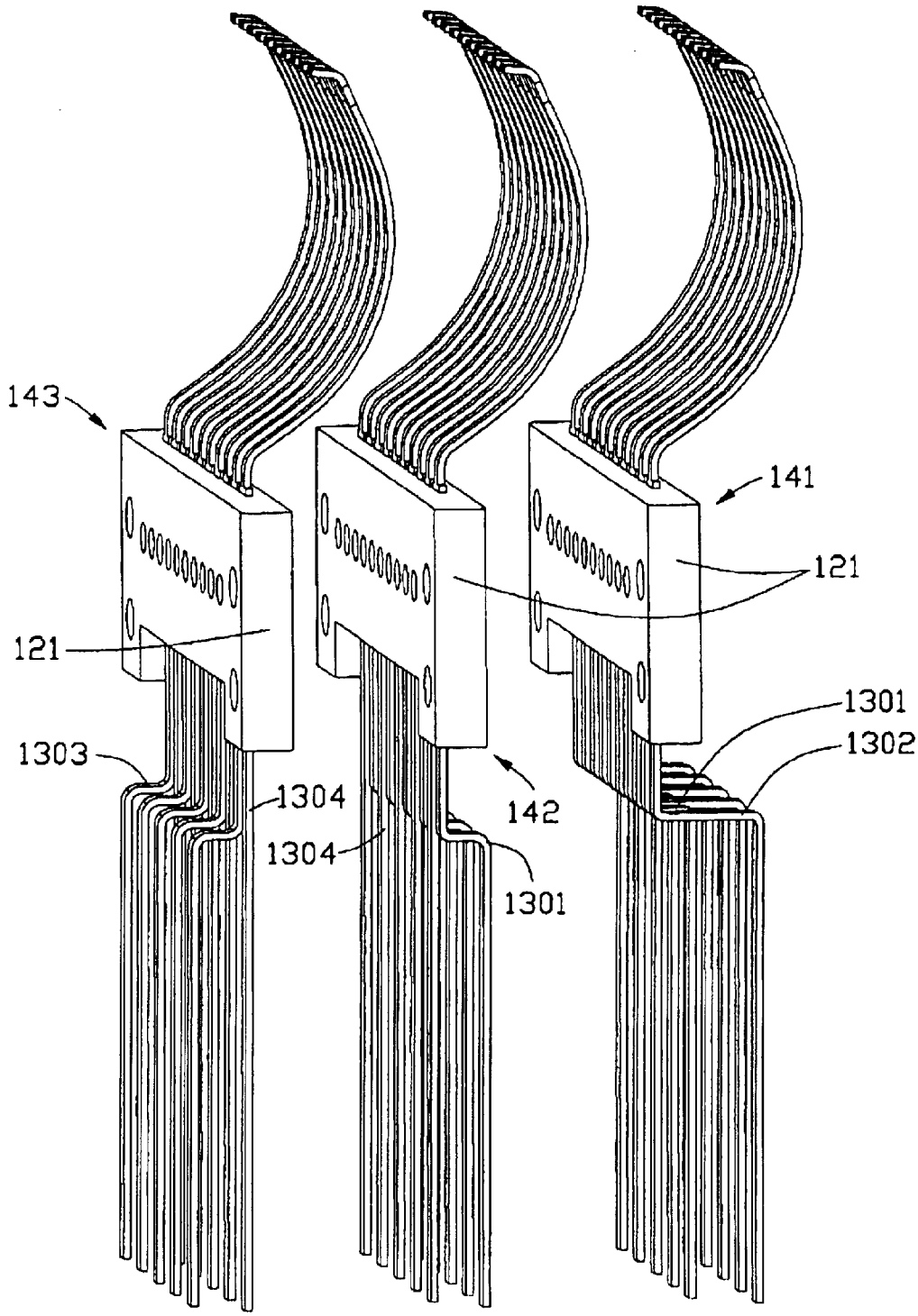
FIG. 5 is an enlarged, exploded, isometric view of first contact team including three contact modules each consisting of terminals and one of the first holding elements of FIG. 1.
Figure 6:
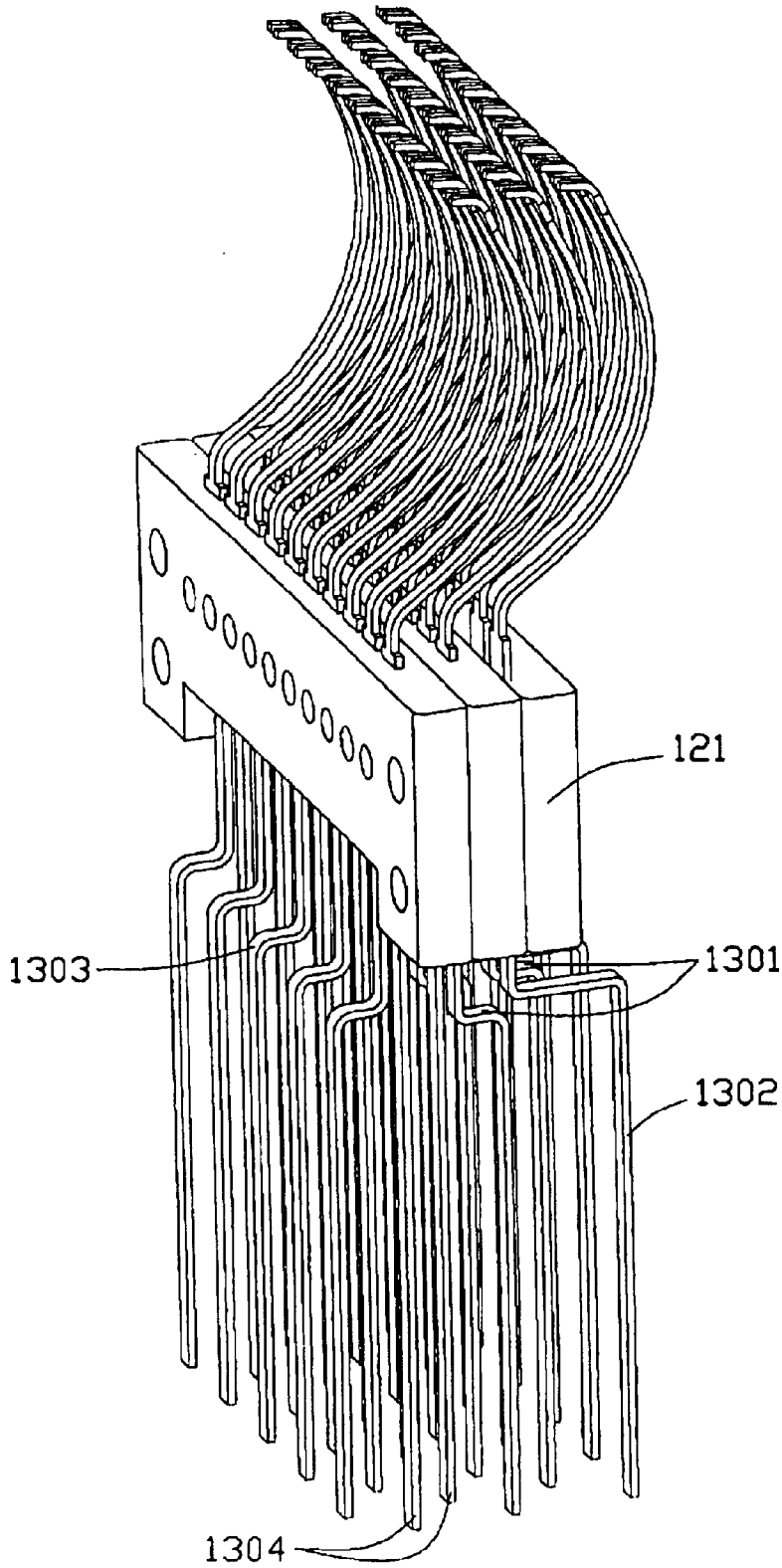
FIG. 6 is an assembled, isometric view of the first contact team of FIG. 5.
Figure 7:
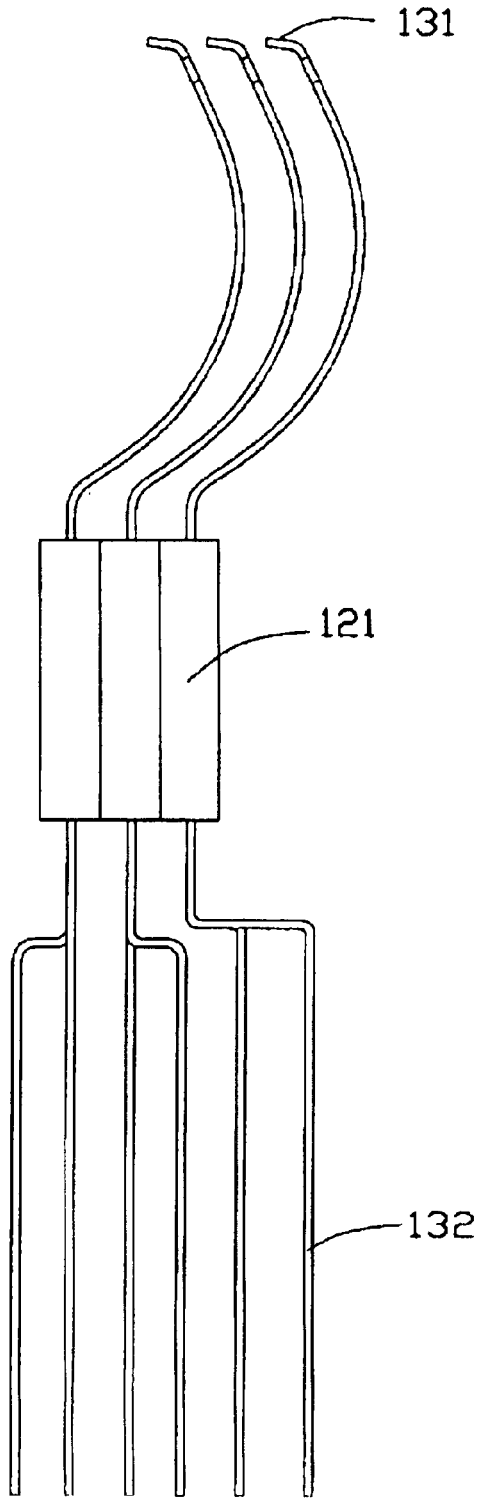
FIG. 7 is an side elevation of the first contact team of FIG. 6.

Referring to FIGS. 5 to 7, in accordance with lengths of the connecting portions 134 of the terminals 13, the terminals 13 can be grouped under four types such as first terminals 1301, second terminals 1302, third terminals 1303 and fourth terminals 1304. Each connecting portions 134 has a desired length in a desired direction. In the preferred embodiment of the present invention, the connecting portion 134 of each of the first terminals 1301 extending horizontally in a first direction has a length "L", the connecting portion 134 of each of the second terminals 1302 extending horizontally has a length "2L", the connecting portion 134 of each of the third terminals 1303 extending horizontally in an opposite direction to the first direction has a length "L", and the length of each of the fourth terminals 1304 is zero, that is to say, each have not the connecting portion.

Referring to FIGS. 3 through 6, the holding component 12 comprises six first holding elements 121, a pair of second holding elements 122, a third holding element 123 and a fourth holding element 124.

Each of the first holding elements 121 is generally rectangular, and defines a pair of spaced apertures 1211 in each of two opposite sides thereof. The holding portions 133 of five first terminals 1301 and five second terminals 1302 are staggered relative to each other and embedded in one first holding element 121 by insert molding, so as to form a first contact module 141. The holding portions 133 of five first terminals 1301 and five fourth terminals are staggered relative to each other and embedded in one first holding element 121, so as to form a second contact module 142. The holding portions 133 of five third terminals and five fourth terminals 1304 are staggered relative to each other and embedded in one holding element 121, so as to form a third contact module 143. The first, second and third modules 141, 142, 143 are assembled by four bolts (not shown) passing through the apertures 1211 and engaging with four nuts (not shown) respectively, so as to form a first contact team. There is a second contact team being the same as the first contact team.

Referring to FIGS. 6 and 7, in one contact team, the first contact portions 131 of the terminals 13 are arranged in three rows, but the second contact portions 132 of the terminals 13 are arranged in six rows because of the connecting portion 134. In addition, a distance between two adjacent second contact portions 132 in one row is as twice as a distance between two adjacent first contact portions 131 in one row. A distance between the third holes 33 of the burn-in board 3 in one row, which is the same as the distance between the second contact portions 132 in one row, is increased. Therefore, it is likely to decreases the difficulty of making third holes 33 in the burn-in board 3 and assembling the second contact portions 132 into the burn-in board 3 by Through Hole technology.

Figure 4:
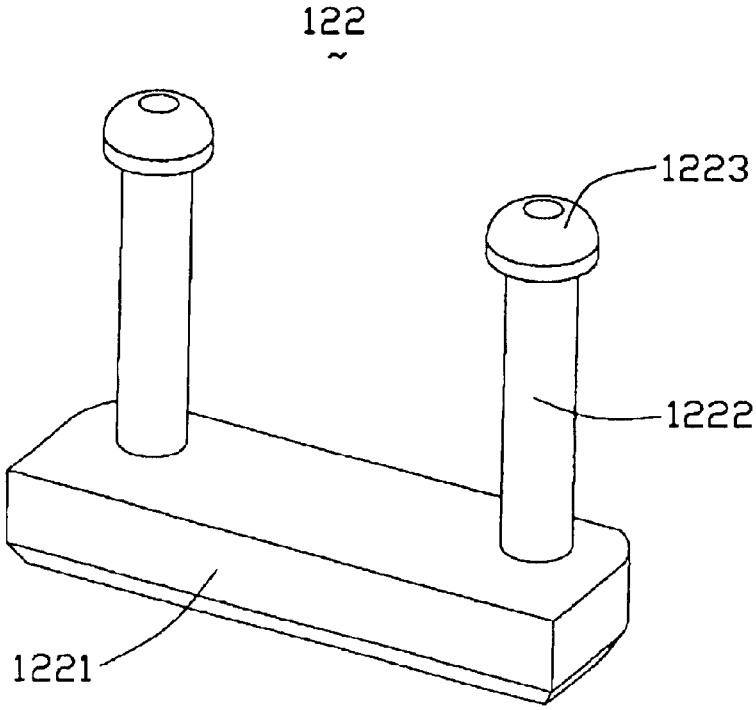
FIG. 4 is an enlarged, isometric view of one of the second holding elements of the IC socket assembly of FIG. 1.

Referring to FIG. 4, the second holding element 122 comprises a generally rectangular body portion 1221 and a pair of first posts 1222 formed at two opposite sides of the body portion 1221. Each of the first posts 1222 extends upwardly from a top surface of the body portion 1221, and having a cap 1223 on a top end thereof.

Figure 8:
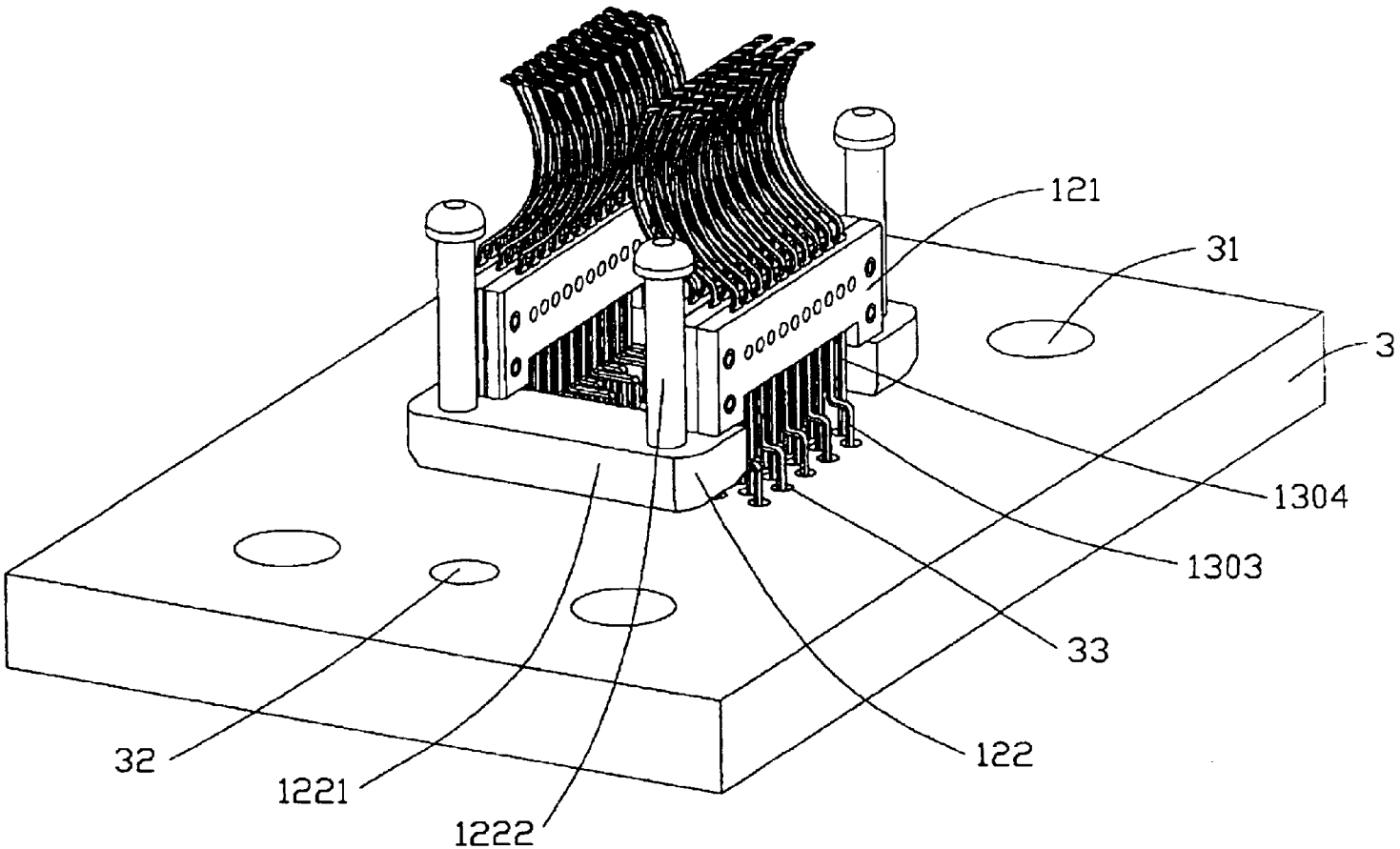
FIG. 8 is an assembled, isometric view of the contact teams of FIG. 6 and the second holding elements of FIG. 4, together with a burn-in board.

Referring to FIG. 8, the second holding elements 122 are put on the burn-in board 3 at intervals. Referring to FIG. 8, the first and second contact teams are assembled on the burn-in board 3, with the second contacts 132 inserted through the third holes 33 of the burn-in board 3 only, and bottoms of the first holding elements 121 abutting against tops of the body portions 1221 of the first holding elements 122.

Figure 10:
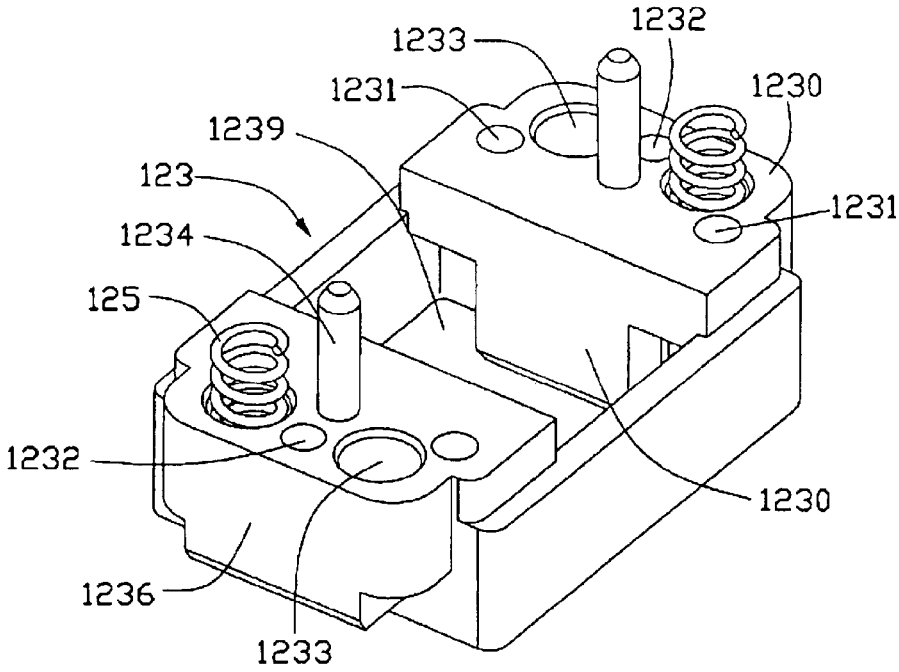
FIG. 10 is an isometric view of the third holding element of the IC socket assembly of FIG. 1.
Figure 11:
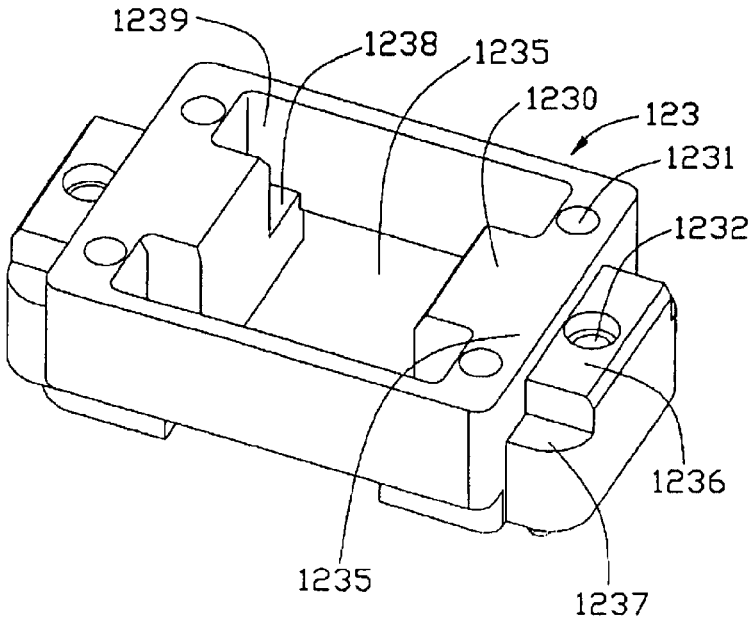
FIG. 11 is an isometric view of the third holding element of FIG. 10, but showing the third holding element inverted.

Referring to FIGS. 10 and 11, the third holding element 123 is a general frame, defining a first window 1235 in a middle portion thereof. A pair of T-shaped positioning portions 1230 each is formed inner surfaces of front and end walls of the frame respectively. Each positioning portion 1230 forms a receiving space 1239 with a corresponding sidewall of the frame. A height of the positioning portion 1230 is higher than a height of the frame. Each positioning portion 1230 forms a step surface 1238. A pair of T-shaped ear portion 1236 is formed outer surfaces of the front and end walls of the frame. Each ear portion 1236 forms an engaging surface 1237, and defines a step hole 1232 in a middle portion thereof. Each step hole 1232 extends through the ear portion 1236 in a vertical direction. A top surface of each ear portion 1236 is flush with a top surface of each positioning portion 1230, with a top portion of ear portion 1236 connecting with a top portion of the positioning portion 1230. A pair of first recesses 1233 is defined in two opposite sides of each of the ear portions 1236. Four first coil springs 125 are assembled onto the third holding element 123, with ends of the first coil springs 125 abutting against portions under the first recesses 1233 respectively. A pair of first receiving holes 1231 in two opposite sides of the top portion of the third holding element 123, corresponding to the first posts 1222 of the second holding elements 122. Each of the first receiving holes 1231 extends through the third holding element 123 in a vertical direction. A second post 1234 extends upwardly from a top surface of the third holding element 123 between the first receiving holes 1231.

Figure 12:
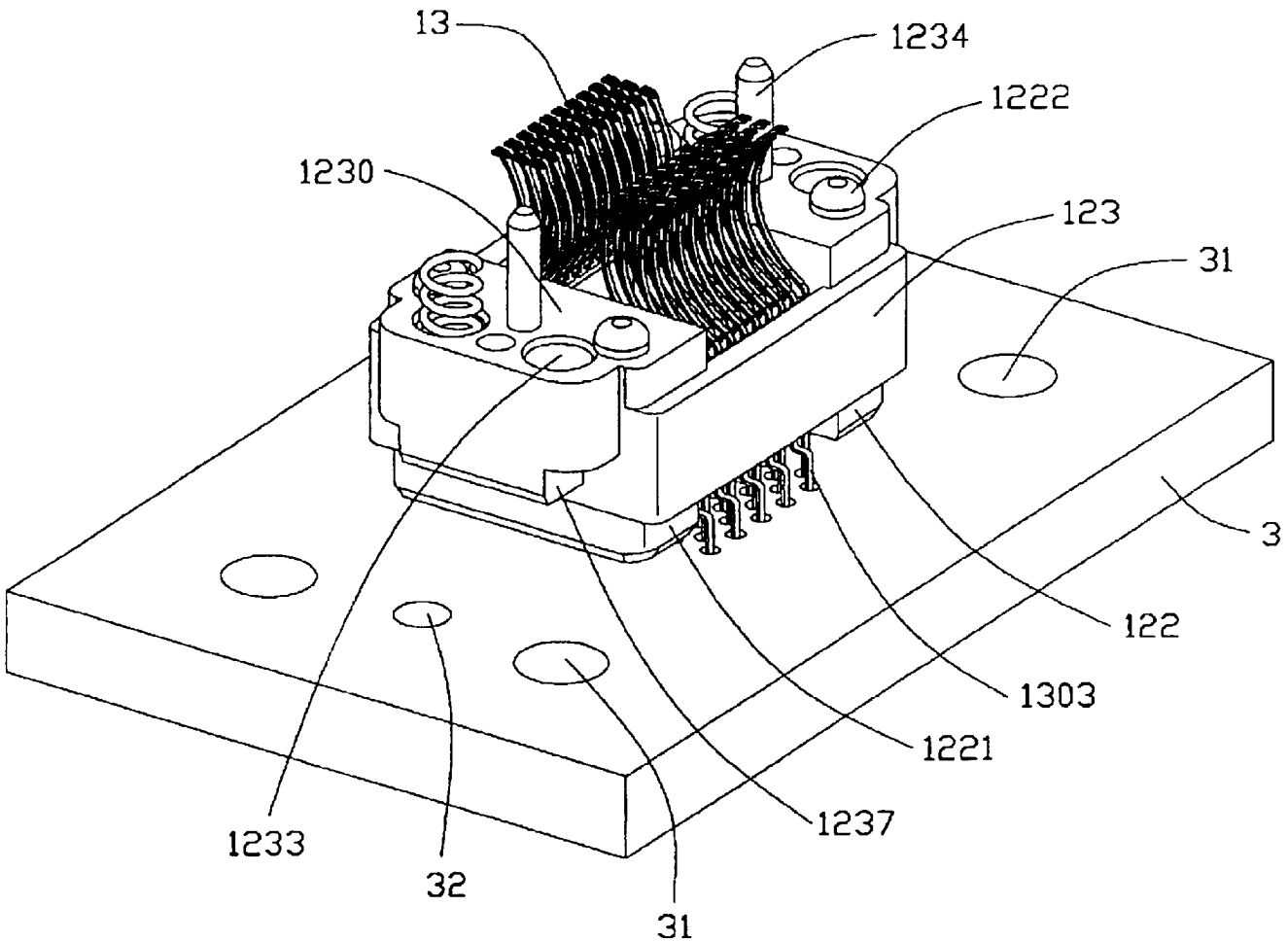
FIG. 12 is an assembled, isometric view of an assembly of FIG. 8 and the third holding element of FIG. 10.

Referring to FIG. 12, the third holding element 123 is assembled onto the second holding elements 122, with a bottom surface of the front and end walls of the third holding element 123 abutting against the top surface of the body portion 1221 of the second holding elements 122 respectively, the first and second contact team received in the receiving spaces 1239 respectively, the first step surfaces 1238 of the positioning portions 1230 abutting against tops of the first holding elements 121, and the first posts 1222 of the second holding elements 122 inserted through the first receiving holes of the third holding element 123 with the caps 1223 engaging with the top surfaces of the top surface of the third holding element 123.

Figure 13:
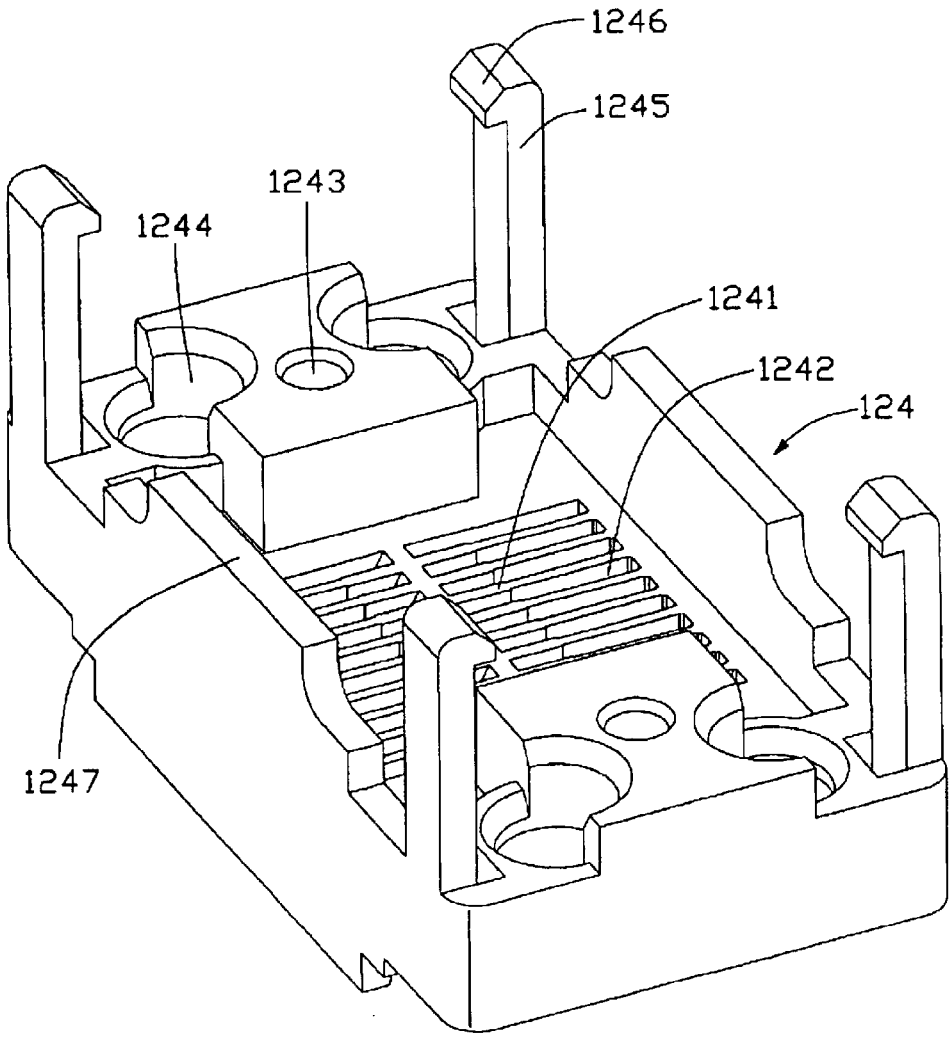
FIG. 13 is an enlarged, isometric view of the fourth holding element of the IC socket assembly of FIG. 1, showing the fourth holding element from a bottom side.
Figure 14:
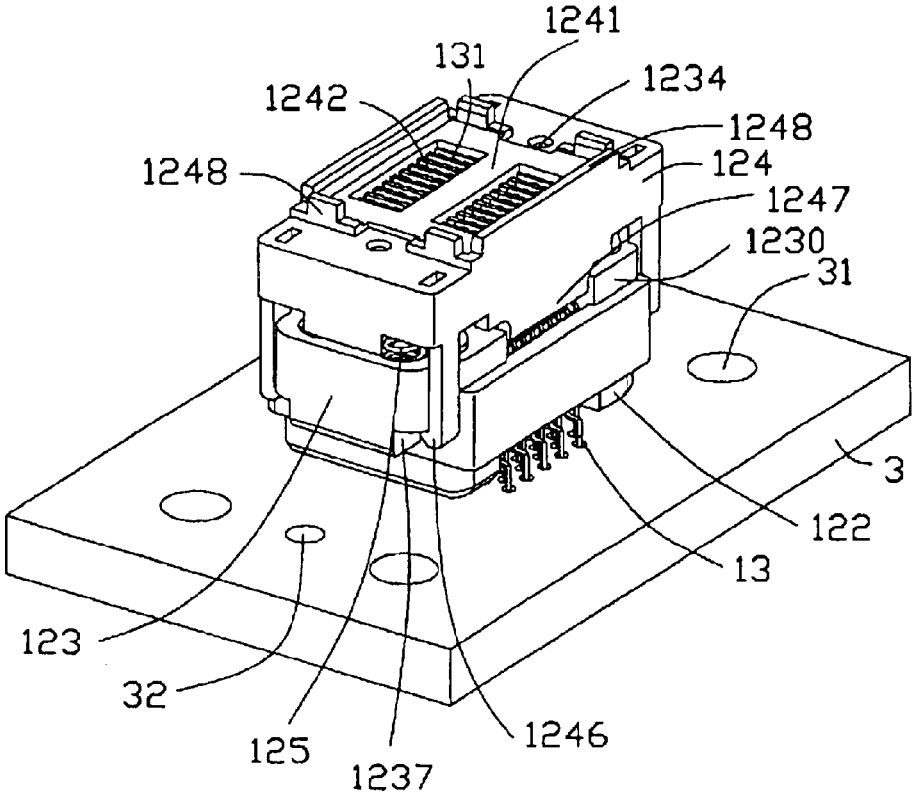
FIG. 14 is an assembled, isometric view of an assembly of FIG. 12 and the fourth holding element of FIG. 13.

Referring to FIG. 13, there is shown an isometric view of the fourth holding element 124 from a bottom side. The fourth holding element 124 comprises a base portion 1241 and four latches 1245 extending downwardly from four corners of the base portion 1241. Each latch 1245 forms a clasp 1246 at a free end thereof. A pair of second recesses 1244 and a second receiving hole 1243 are defined in bottom of each of the front and end sides of each of base portion 1241. Each second receiving hole 1243 extends through the base portion 1241 in a vertical direction, the second receiving hole 1243 between the second recesses 1244. Twenty slots 1242 are defined in a middle portion of the base portion 1241, the slots 1242 arranged in two rows and extending through the base portion in the vertical direction. A pair of tongues 1247 protrudes from two opposite sidewalls of the base portion 1241 respectively. Referring to FIG. 14, the base portion 1241 forms some projecting portions 1248 extending upwardly from a top thereof. The projecting portions 1248 are arranged in a generally rectangle, thereby forming a receiving cavity therebetween.

The fourth holding element 124 is assembled onto the third holding element 123, with the clasp 1246 engaging with the engaging surface 1237 of the third holding element 123, the tongues 1247 received between the positioning portions 1230, the second posts 1234 of the third holding element 123 received in the second receiving holes 1243 of the fourth holding element 124, opposite ends of the first coil springs 125 abutting against portions over the second recesses 1244, and the first contact portions 131 of terminals 13 accommodated in the slots 1242 so as to protect the first contact portions 131 from damage.

Figure 1:
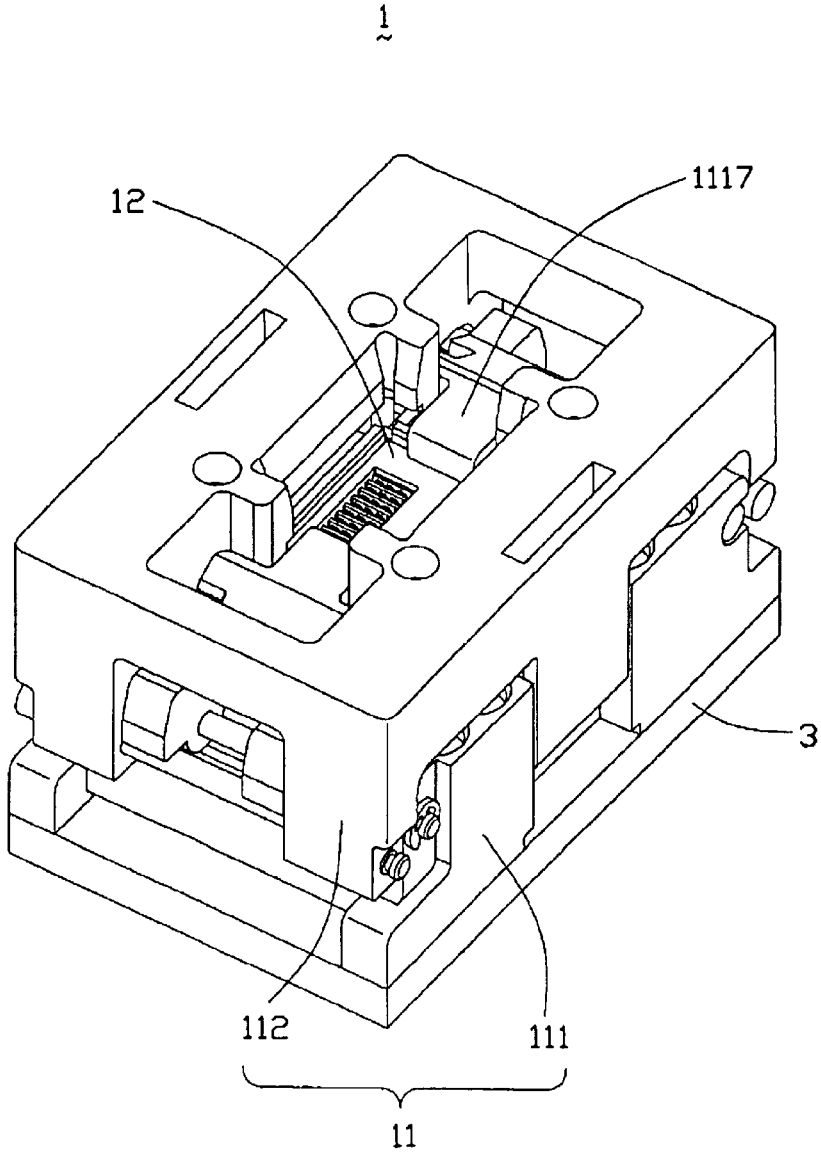
FIG. 1 is an isometric view of an integrated circuit (IC) socket assembly in accordance with the preferred embodiment of the present invention, wherein the IC socket assembly includes an insulative housing with a first body and a second body, a holding component with six first holding elements, two second holding elements, a third holding element and a fourth holding element, a plurality of electrical terminals being grouped under four types such as first terminal, second terminal, third terminal and fourth terminal, and a pair of pushing members.

Referring to FIG. 1, the housing 11 comprises a first body 111 and a second body 112 assembled onto the first body 111.

Figure 15:
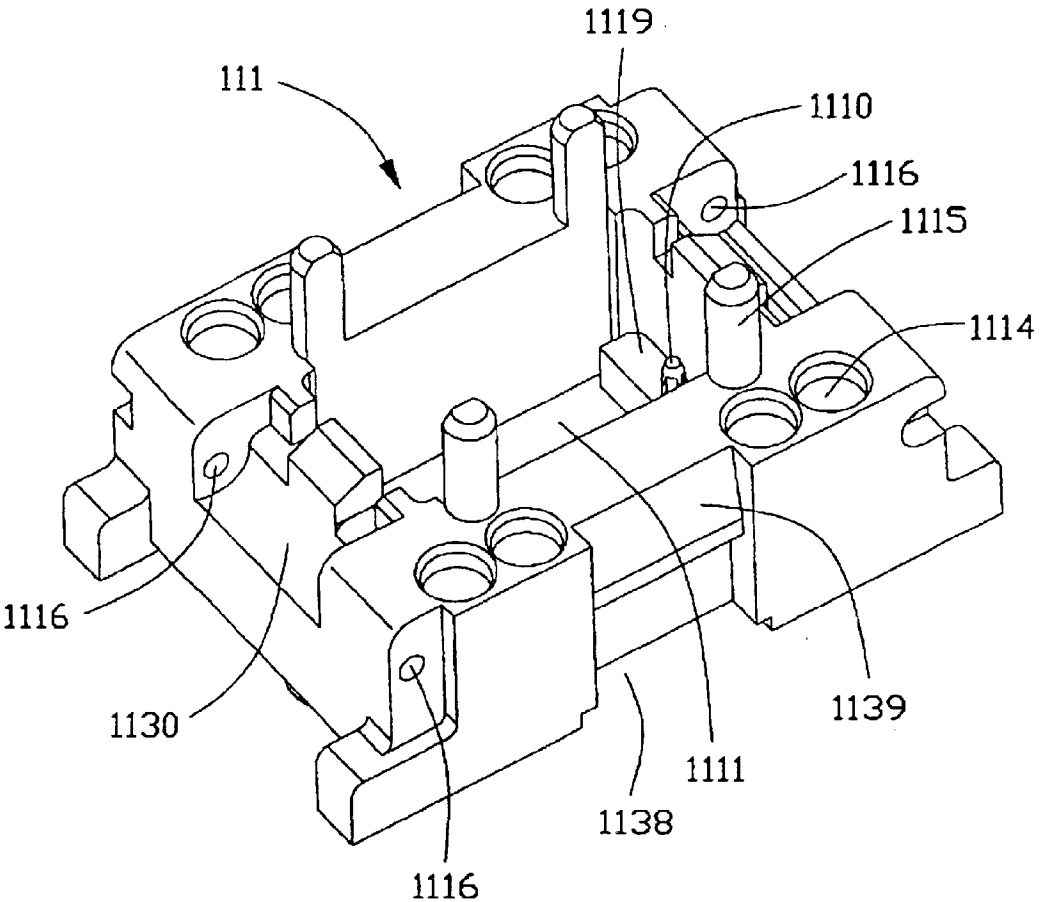
FIG. 15 is an isometric view of the first body of the IC socket assembly of FIG. 1.
Figure 16:
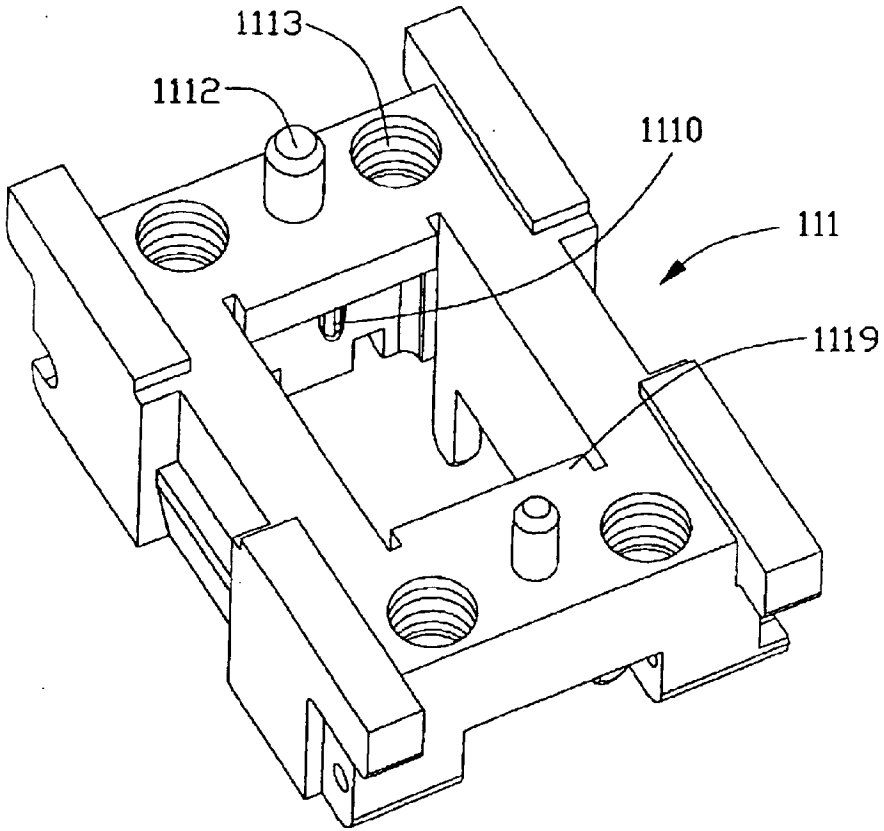
FIG. 16 is an isometric view of the first body of FIG. 15, but showing the first body inverted.

Referring to FIG. 15, there is shown an isometric view of the first body 111 from a top side. The first body 111 is a generally frame, defining a second window 1111 in a middle thereof. A pair of near third recesses 1114 is defined in each of two opposite sides of a top portion of each of two opposite sidewalls of the frame. A third post 1115 is formed at each of four inner corners of the frame, the third post 1115 extending upwardly from a top portion of the first body 111 and having a vertical cutout paralleling a central axis thereof. A receiving gap 1130 is defined in a middle portion of each of front and end walls of the frame respectively, and a first hollow 1116 extends through two portions adjacent the receiving gap 1130 in a transverse direction of the frame. A portion under the receiving gap 1130 has an arc-shaped surface. A pair of steps 1119 extends from inner surface of the frame into the second window 1111. Also referring to FIG. 16, a bottom surface of each of the step 1119 is flush with a bottom surface of the frame respectively. A fourth post 1110 extends upwardly from a top surface of each of the step 1119, corresponding to the first step holes 1232 of the third holding elements 123. Four screw holes 1113 are defined in four corners of bottom portion of the frame. A pair of fifth post 1112 extends downwardly from the bottom surface of each the front and end walls of the frame, corresponding to the second holes 32 of the burn-in board 3. In accordance with the second holes 32 of the burn-in board 3, a diameter of one fifth post 1112 is larger than a diameter of the other fifth post 1112 to provide polarizing means. A pair of cutouts 1138 is defined in middle portions of the sidewalls of the frame respectively. A wedge 1139 extends from the sidewall into each of the cutout 1138.

Figure 17:
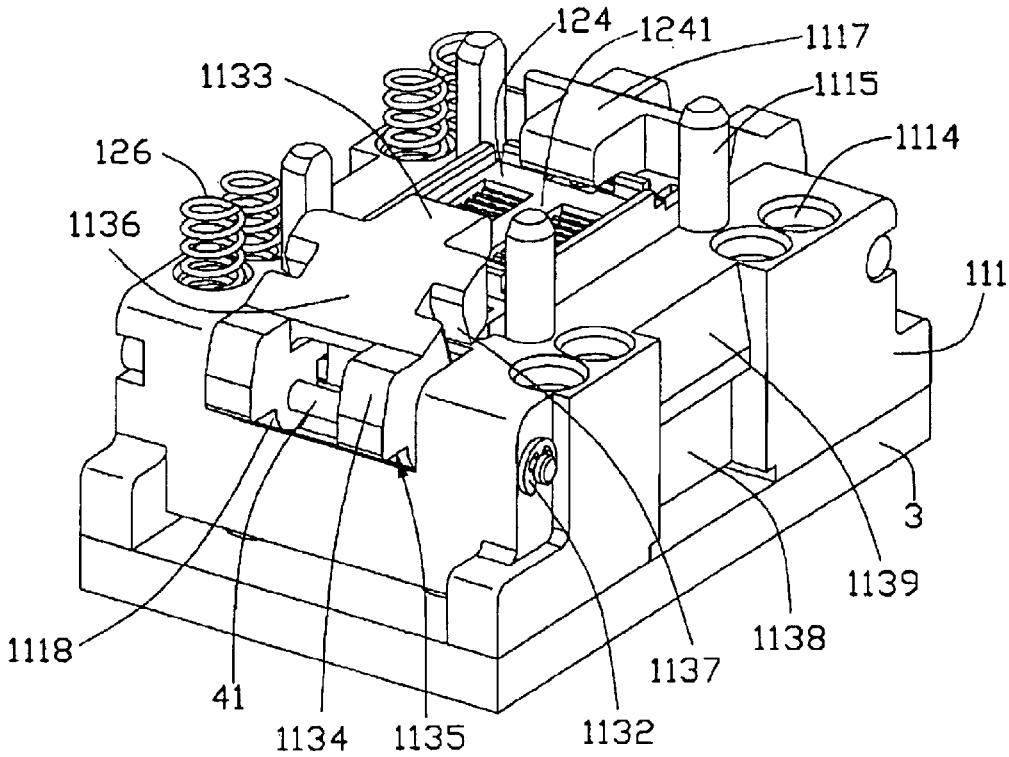
FIG. 17 is an assembled, isometric view of an assembly of FIG. 14 and the first body of FIG. 15.

Referring to FIG. 17, the assembled first, second contact teams and second, third, fourth holding elements 122, 123, 124 are detached from the burn-in board 3. The first body 111 is assembly onto the burn-in board 3, with the fifth posts inserted through the second holes 32 of the burn-in board 3. Then, the assembled first, second contact teams and second, third, fourth holding elements 122, 123, 124 is assembled in the second window 1111, with the fourth posts 1110 received in the first step holes 1236 of the third holding element 123. Further, the pushing members 1117 are assembled into the receiving gaps 1130 of the first body 111 respectively. Each pushing member 1117 comprises a head 1133, a middle portion 1136 and a pair of tails 1134 extending from an end of the head 1133. The middle portion 1136 defines a pair of notches 1137 in two sides thereof. The tail 1134 has an arc-shaped surface 1118 abutting against the arc-shaped surface under the receiving gap 1130, and an abutting surface 1135 extending from an end of the arc-shaped surface 1118, and a third hollow extending therethrough. A pair of first spindles 41 are inserted through the first hollows 1116 and the third holes of the pushing members 1117 respectively and engaging with first fastening rings 1132, thereby mounting the pushing members 1117.

Figure 18:
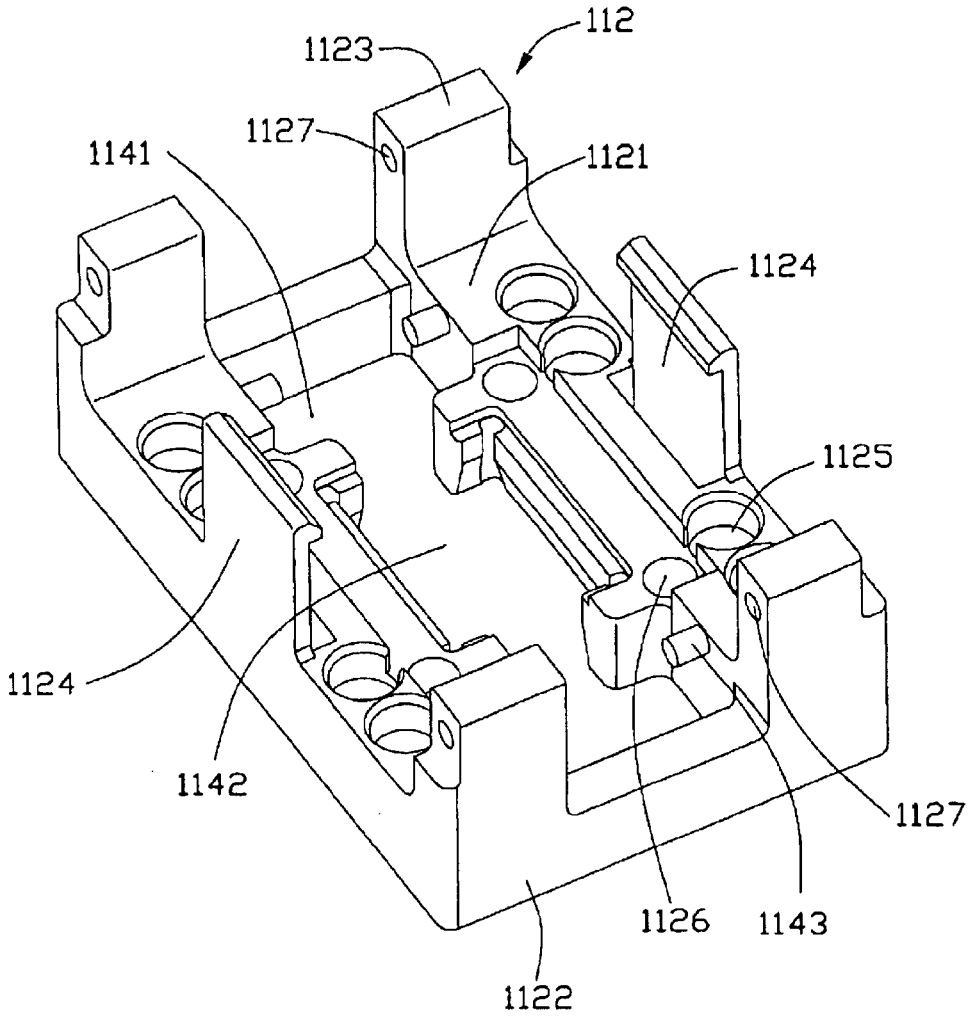
FIG. 18 is an enlarged, isometric view of the second body of the IC socket assembly of FIG. 1, showing the second body from a bottom side.

Referring to FIG. 18, there is shown an isometric view of the second body 112 from a bottom side. The second body 112 comprises a frame body 1122, four protrusions 1123 extending downwardly from four corners of the frame body 1122, and a pair of extending portions 1124 extending downwardly from in middle portions of edges of two opposite sidewalls 1121 of the frame body 1122. Each extending portion 1124 forms a claw at a free end thereof. Each protrusion 1123 defines a second hollow 1127 extending through the protrusion 1123. The second hollows 1127 of the near protrusion 1123 have an identical axis. Each sidewall 1121 of the frame body 1122 defines four fourth recesses 1125, and a pair of spaced third receiving holes 1126 in a middle portion thereof. Two of the fourth recesses 1125 are defined in one of two opposite sides of the sidewall 1121. The frame body 1122 defines a pair of fourth windows 1141 in front and end sides thereof, and a third window 1142 in a middle portion thereof between the fourth windows 1141. A pair of short pins 1143 is formed in each of the fourth windows 1141. Each pin 1143 extends from an inner surface of one of the sidewall 1121 into the fourth window 1141.

Figure 19:
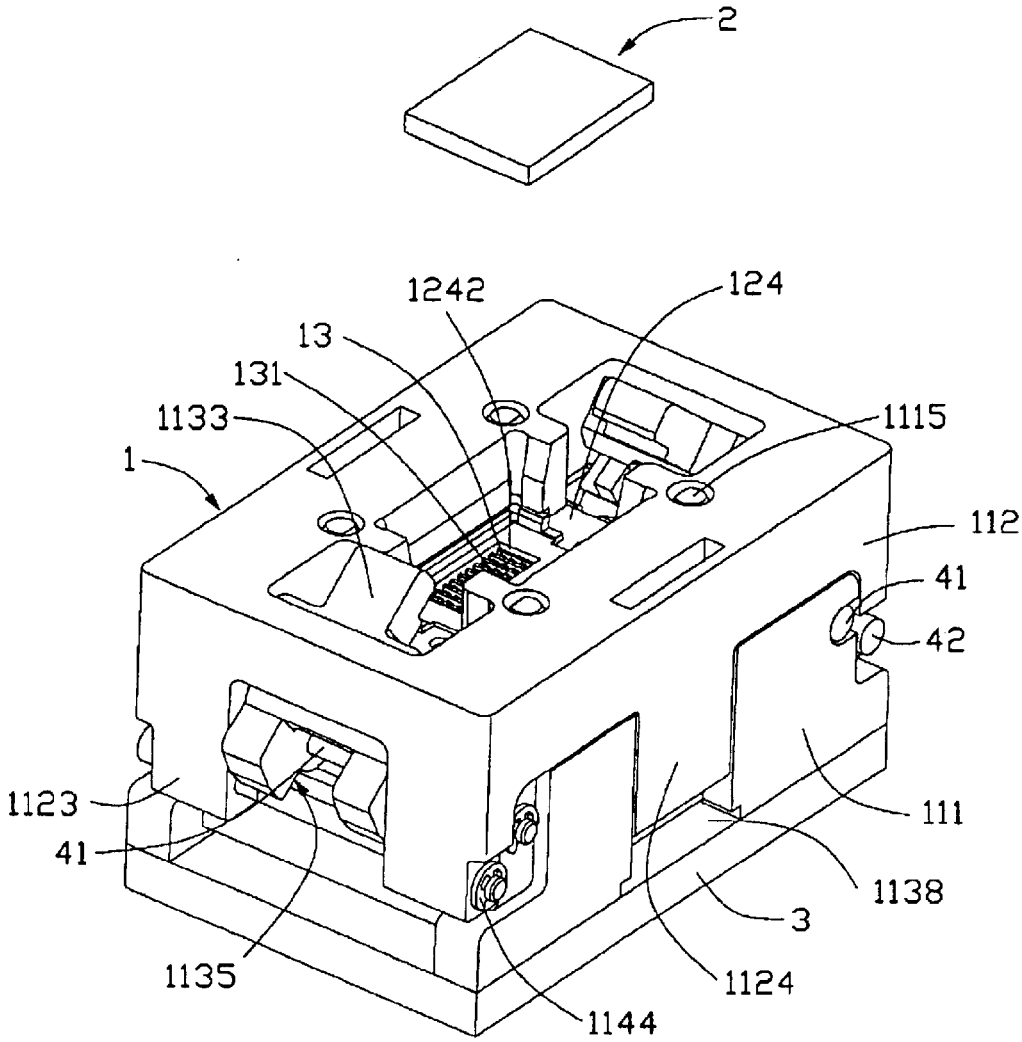
FIG. 19 is an isometric view of the IC socket assembly of FIG. 1, together with an IC ready to mate with the IC socket assembly.

Referring to FIG. 19, the second body 112 is assembled onto the first body 111, with the extending portions 1124 received in the cutouts 1138 with the claws engaging with the wedges 1139 respectively, the pushing members 1117 received in the fourth windows 1141 respectively, the pins 1143 received in the notches 1137 of the pushing members 1117, the third posts 1115 received in the third receiving holes 1126, a bottom surface of the frame body 1122 abutting against the top surface of the fourth holding element 124. Eight second coil springs 126 are assembled into the first body 111, with ends of the second coil springs 126 abutting against portions under the third recesses 1114 and opposite ends of the second coil springs 126 abutting against portions over the fourth recesses 1125 of the second body. A pair of second spindles 42 is inserted through the second hollows 1127 and engages with second fastening rings 1144, with abutting against the abutting surfaces 1135 of the pushing members 1117 respectively.

Figure 20:
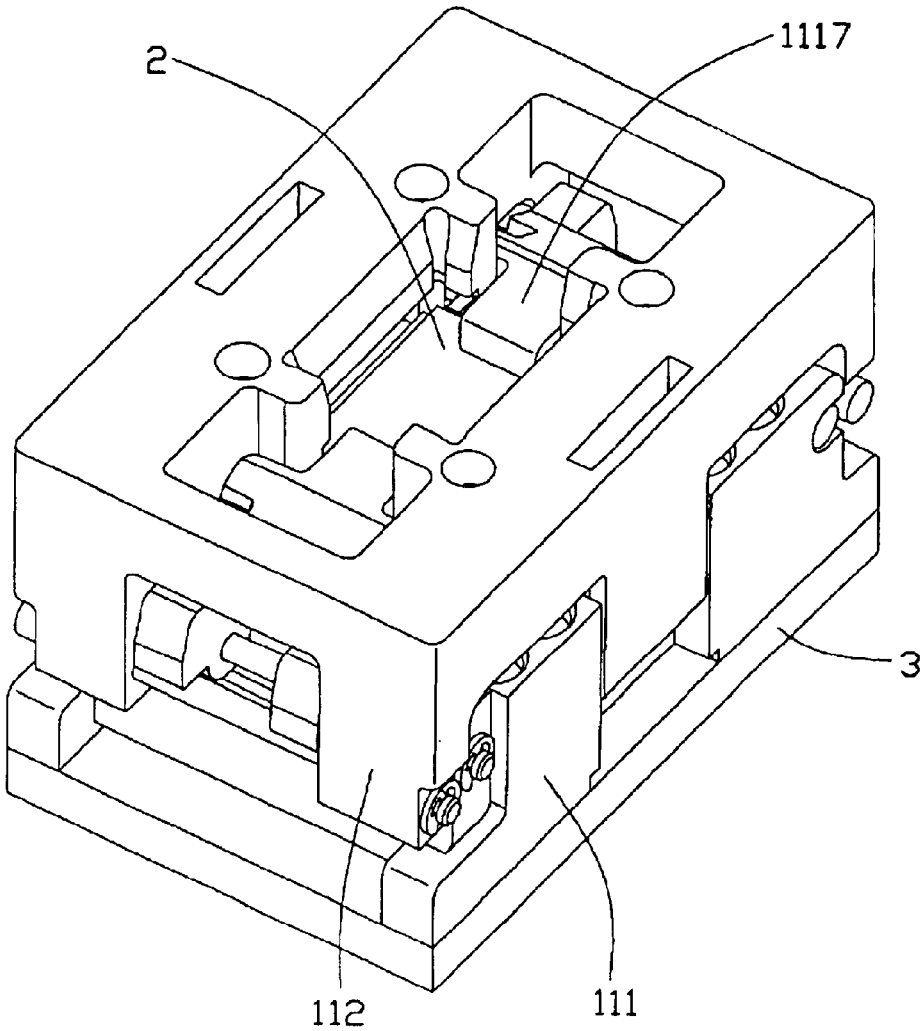
FIG. 20 is an isometric view of the IC socket assembly of FIG. 1, together with the IC mating with the IC socket assembly.

Also referring to FIG. 20, in assembly, the second contact portions 132 of terminals 13 are inserted through the third holes 33 and electrically connect with the burn-in board 3. Four screws (not shown) are inserted through the first holes 31 of the burn-in board 3, and engage in the screw holes 1113 of the first body 1111.

In use, the second body 112 of the IC socket assembly 1 is pushed down. The pushing members 1117 rotate and the heads 1133 of the pushing members 1117 rise. An IC 2 is put into the receiving cavity of the fourth holding element 124 by the third window 1142 of the second body 112. The second body 112 is released and rises under compression from the second coil spring 126. The pushing members 1117 rotate by the second spindles engaging with the abutting surfaces 1135, and the heads 1133 of the pushing members 1117 go down to press a top surface of the IC 2. The IC 2 pushes the fourth holding element 124 against the first coil springs 125. The second contact portions 131 of the terminals 13 protrude from the slots 1242 of the fourth holding element 124, so as to electrically contact the IC 2. Therefore, the IC socket assembly 1 electrically connects the IC 2 with the burn-in board 3.

From the foregoing it will be recognized that the principles of the invention may be employed in various arrangements to obtain the features, advantages and benefits described above. It is to be understood, therefore, that even though numerous characteristics and advantages of the invention have been set forth together with details of the structure and function of the invention, this disclosure is to be considered as illustrative only. Various changes and modifications may be made in detail, especially in matters of size, shape and arrangements of parts, without departing from the spirit and scope of the invention as defined by the appended claims.

What is claimed is:

1. An integrated circuit socket assembly comprising:

an integrated circuit;

a burn-in board with a plurality of holes;

an insulative housing comprising a first body and a second body mounted onto the first body;

a plurality of first and second electrical terminals received in the housing, each of the plurality of first and second electrical terminals comprising:

a first contact portion for electrically contacting the integrated circuit;

a holding portion;

a second contact portion inserted through a corresponding hole of the burn-in board; and a connecting portion bending from the holding portion to the second contact portion, wherein the connecting portion of each of the plurality of first terminals has a length "L" and extends in a horizontal direction, and the connecting portion of each of the plurality of second terminals has a length "2L" and extends in the horizontal direction;

a holding component comprising:

a plurality of first holding elements, wherein holding portions of the plurality of first and second electrical terminals are staggered relative to each other and embedded in one of the plurality of first holding elements;

a pair of second holding element mounted on the burn-in-board, the plurality of first holding elements received between the pair of second holding elements;

a third holding element mounted on the pair of second holding elements; and a fourth holding element mounted onto the third holding element and capable of moving relative to the third element, wherein the fourth holding element defining a plurality of slots which each receiving a corresponding first contact portion of the plurality of first and second terminals;

wherein the third holding element has a pair of T-shaped ear portions at front and end sides, respectively, each ear portion defining a step hole in a middle portion thereof, and the first body forming a pair of steps each having a post which receiving in each step holes of the third holding element; and a pair of pushing members mounted onto the first body of the housing and capable of rotation when the second body is moving.

2. The IC socket assembly as claimed in claim 1, wherein the third holding element defines a pair of spaced receiving holes in each of front and end sides thereof, and each of the second holding elements forms a pair of posts received in the receiving holes.

3. The IC socket assembly as claimed in claim 1, wherein the third holding element has a pair of T-shaped ear portions each forming engaging surfaces, and the fourth holding element has four latches extending downwardly from four corners thereof to abut against the engaging surfaces of the third holding element.

4. The IC socket assembly as claimed in claim 1, wherein the third holding element forms a pair of posts, and the fourth holding element defines a pair of receiving holes receiving the posts therein respectively.

5. The IC socket assembly as claimed in claim 1, wherein each of the third and four holding elements defines four recess, and four springs are received in the recesses between the third and fourth holding elements.

6. The IC socket assembly as claimed in claim 1, wherein the first body has four posts each having cutouts, and the second body has four receiving holes receiving the post.

7. The IC socket assembly as claimed in claim 1, wherein each of the first and second bodies defines eight recesses, and eight springs are received in the recesses between the first and second bodies.

8. The IC socket assembly as claimed in claim 1, wherein the first body a pair of cutouts and hollows in portions adjacent the cutouts, and each of the pushing members defines a pair of tails each having hollows, a pair of spindles inserted through the hollows of the first body and the pushing members and engaging with a pair of fastening rings respectively.

9. The IC socket assembly as claimed in claim 1, wherein the pushing members has a pair of tails each having abutting surfaces, and the second body forms four protrusions each having hollows, a pair of spindles inserted through the hollows, engaging with a pair of fastening rings and abutting against the abutting surfaces of the pushing members.

* * * * *